US005681688A

United States Patent [19]

Takamuki

[11] Patent Number: 5,681,688

[45] Date of Patent: *Oct. 28, 1997

[54] SILVER HALIDE PHOTOGRAPHIC LIGHT-SENSITIVE MATERIAL

[75] Inventor: Yasuhiko Takamuki, Hino, Japan

[73] Assignee: Konica Corporation, Tokyo, Japan

[ * ] Notice: The term of this patent shall not extend beyond the expiration date of Pat. No. 5,414,986.

[21] Appl. No.: 365,064

[22] Filed: Dec. 28, 1994

Related U.S. Application Data

[63] Continuation of Ser. No. 117,861, Sep. 7, 1993, abandoned.

[30] Foreign Application Priority Data

Sep. 10, 1992 [JP] Japan ..... 4-242030

[51] Int. Cl.[6] ..... G03C 1/94

[52] U.S. Cl. ..... 430/537; 430/531; 430/536

[58] Field of Search ..... 430/537, 536, 430/531

[56] References Cited

U.S. PATENT DOCUMENTS

| | | | |
|---|---|---|---|
| 2,831,767 | 4/1958 | Dann et al. | 430/628 |
| 3,525,620 | 8/1970 | Nishio et al. | 430/536 |
| 4,264,719 | 4/1981 | Kameoka et al. | 430/537 |
| 4,542,093 | 9/1985 | Suzuki et al. | 430/531 |
| 4,714,671 | 12/1987 | Helling et al. | 430/537 |
| 4,822,727 | 4/1989 | Ishigaki et al. | 430/537 |
| 4,908,155 | 3/1990 | Leemans et al. | 430/537 |
| 4,914,012 | 4/1990 | Kawai | 430/537 |
| 5,004,669 | 4/1991 | Yamada et al. | 430/531 |
| 5,037,729 | 8/1991 | Furlan | 430/537 |
| 5,415,986 | 5/1995 | Fujita et al. | 430/537 |

FOREIGN PATENT DOCUMENTS

| | | |
|---|---|---|
| 232 412 | 5/1983 | European Pat. Off. . |
| 0 495 314 | 7/1992 | European Pat. Off. . |

*Primary Examiner*—John S. Chu

*Attorney, Agent, or Firm*—Frishauf, Holtz, Goodman, Langer & Chick, P.C.

[57] ABSTRACT

A silver halide photographic light-sensitive material is disclosed. The light-sensitive material comprises a support and a light-sensitive silver halide emulsion layer provided on the support, and the silver halide emulsion layer or a non-light-sensitive hydrophilic colloid layer provided on the support contains a polymer latex which is stabilized with gelatin and has a pH value of from 6.5 to 10.0 at the time of addition to a coating solution for forming the emulsion layer or the hydrophilic colloid layer.

15 Claims, No Drawings

SILVER HALIDE PHOTOGRAPHIC LIGHT-SENSITIVE MATERIAL

This application is a continuation of application Ser. No. 08/117,861, filed Sep. 7, 1993, now abandoned.

FIELD OF THE INVENTION

The present invention relates to a silver halide photographic light-sensitive material, and more particularly to a silver halide photographic light-sensitive material which is excellent in the dimensional stability and free from any such trouble as blocking or sensitivity drop during its storage of long duration.

BACKGROUND OF THE INVENTION

In a silver halide photographic light-sensitive material, gelatin is generally used as the binder for its layers. Gelatin has a high swellability and a high gelling capacity; is easily crosslinkable with various hardeners; and thus is a very excellent binder for uniformly coating over a wide area a thermophobic material like a light-sensitive silver halide by adjusting the physical characteristics of its coating liquid.

The silver halide grain of a photographic light-sensitive material, with its gelatin layers absorbing water enough to swell during its processing, is transformed into a very hard metallic silver grain. Therefore, the emulsion layer does not return to its original state after its drying, thus resulting in a difference in the dimensions between before and after the processing of the same light-sensitive material.

There are well known techniques for improving the physical properties of a light-sensitive material by having a polymer latex contained in its silver halide emulsion and backing layers.

Examples of the above techniques include those as disclosed in Research Disclosure 19951; JP E.P.(Examined-Publication) Nos. 4272/1964, 17702/1964 and 13482/1968; and U.S. Pat. Nos. 2,376,005, 2,763,625, 2,772,166, 2,852,386, 2,853,457 and 3,397,988. Further, JP O.P.I.(Open to Public Information) Nos. 38741/1984, 296348/1986, 284756/1986 and 285446/1986 disclose methods for incorporation of fine oily droplets of paraffin or vinyl polymers.

However, if to gelatin is added a latex in an amount enough to improve the dimensional stability of a light-sensitive material, it causes the light-sensitive material to be subject to such trouble as blocking or sensitivity drop during its long-term storage.

SUMMARY OF THE INVENTION

It is an object of the present invention to provide a silver halide photographic light-sensitive material which is excellent in the dimensional stability and free from any such trouble as blocking or sensitivity drop during its long-term storage.

The above object of the invention is accomplished by a silver halide photographic light-sensitive material comprising a support having thereon at least one light-sensitive silver halide emulsion layer, in which at least one of the hydrophilic colloid layers including the light-sensitive silver halide emulsion layer comprises a polymer latex stabilized with gelatin, and pH of the polymer latex at the time of its addition to the coating liquid for the layer is 6.5 to 10.0.

A more preferred embodiment is that the layer containing the polymer latex stabilized with gelatin further contains an additional water-soluble polymer.

DETAILED DESCRIPTION OF THE INVENTION

The polymer latex stabilized with gelatin used in the invention comprises polymer particles dispersed in a medium, and the dispersion state of the particles is stabilized by the presence of gelatin at the surface and/or inside of the polymer particles. It is particularly preferable that the latex-constituting polymer and gelatin combine in some state;—the polymer and gelatin may combine either directly or through a crosslinking agent with each other.

The polymer latex stabilized with gelatin of the invention can be obtained in the manner that after completion of the polymerization reaction of the polymer latex, to the reaction system thereof is added an aqueous gelatin solution to be made react therewith. It is preferable that a polymer latex synthesized in a surfactant is reacted with gelatin by using a crosslinking agent. The gelatin-stabilized polymer latex can also be obtained by having gelatin present in the latex polymerization reaction system; this provides better results than the above. In this instance, it is better not to have any surfactant present during the polymerization reaction, but if a surfactant should be used, the amount added is preferably 0.1 to 3.0%, and more preferably 0.1 to 2.0%. Even in the latter method, further addition of a gelatin solution after completion of the polymerization reaction brings more preferred results.

The gelatin:polymer proportion in the synthesis is preferably 1:100 to 2:1, and more preferably 1:50 to 1:2.

It is particularly preferable to add a water-soluble polymer to the polymer latex of the invention at a time after the completion of the polymerization reaction. The added amount of the water-soluble polymer is preferably 1 to 100% by weight, more preferably 5 to 50% by weight of the polymer particles of the latex.

The average particle size of the polymer latex stabilized with gelatin is in the range of preferably 0.005 to 1 μm, and more preferably 0.02 to 0.5 μm.

Examples of the polymer particle moiety of the polymer latex stabilized with gelatin suitably usable in the invention include alkyl methacrylate homopolymers such as of methyl methacrylate, ethyl methacrylate; styrene homopolymers; copolymers of alkyl methacrylates and styrene with acrylic acid, with N-methylol-acrylamide or with glycidyl methacrylate; alkyl acrylate homopolymers such as of methyl acrylate, ethyl acrylate, butyl acrylate; copolymers of alkyl acrylates and acrylic acid with N-methylol-acrylamide, in which the copolymerizable acrylic acid monomer content is up to 30% by weight; butadiene homopolymers; copolymers of butadiene and styrene with one or more of butoxymethyl acrylamide and acrylic acid; and vinylidenemethyl acrylate-acrylic acid tricomponent copolymers.

Among these polymers, the copolymer of alkyl acrylate and styrene with acrylic acid, N-methylol acrylamide or with glycidyl methacrylate, methyl methacrylate, copolymers of alkyl acrylate with acrylic acid, and copolymers of alkyl acrylate with N-methylol acrylamide are preferable.

In the case of combining gelatin through a crosslinking agent with a polymer latex, examples of the polymer latex-constituting monomer preferably include those having reactive groups such as carboxyl group, amino group, amido group, epoxy group, hydroxyl group, aldehyde group, oxazoline group, ether group, active ester group, methylol group, cyano group, acetyl group and unsaturated carbon bonding. Further, where a cross-linking agent is used, it may be one generally used for gelatin, examples of which include aldehyde, glycol, triazine, epoxy, vinylsulfone, oxazoline, methacryl and acryl crosslinking agents. And, in order to further increase the dispersion stability of the polymer latex stabilized with gelatin of the invention, as one component monomer of the polymer latex there may be preferably used 2-acrylamido-2-methylpropanesulfonic acid (AMPS) or a salt thereof. Copolymers of acrylate, methacrylate, styrene and AMPS with a styrene content of not lower than 2% by weight are most preferable. The added amount of the above monomer is preferably 0.5 to 20% by weight of the whole constituents.

Examples of the gelatin for use in stabilizing the latex of the invention include gelatin, gelatin derivatives, graft polymers of gelatin with other polymers, and in addition, gelatin or its derivatives may be used in combination with other proteins, sugar derivatives, cellulose derivatives, and hydrophilic colloids such as synthetic aqueous homo- or copolymers.

Examples of the above gelatin include lime-treated gelatin, the acid-treated gelatin described in Bull. Soc. Sci. Phot. Japan, No.16, p. 30 (1966), and gelatin's hydrolyzed or enzyme-decomposed products. The above gelatin derivatives include those obtained by the reaction of gelatin with various compounds such as acid halides, acid anhydrides, isocyanates, bromoacetic acid, alkanesultones, vinylsulfonamides, maleinimide compounds, polyalkylene oxides and epoxy compounds. Particular examples of these are described in U.S. Pat. Nos. 2,614,928, 3,132,945, 3,186,846 and 3,312,553; British Patent Nos. 861,414, 1,033,189 and 1,005,784; and JP E.P. No. 26845/1967.

The above proteins for use in combination with gelatin include albumin and casein; the cellulose derivatives include hydroxyethyl cellulose, carboxymethyl cellulose and cellulose sulfate; and the sugar derivatives include sodium alginate and starch derivatives.

The following are examples of the latex applicable to the invention, in which each exemplified latex formula is shown along with its constituents ratio and Gel/Lx ratio by weight, wherein Gel represents gelatin and Lx represents latex.

GL-1

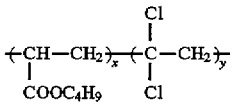

(x/y = 50/50)
Gel/LX = 1/10

GL-2

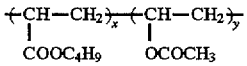

(x/y = 50/50)
Gel/LX = 1/5

GL-3

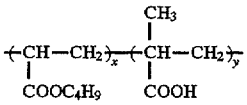

(x/y = 95.6/4.4)
Gel/LX = 1/5

GL-4

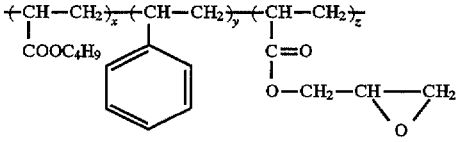

(x/y/z = 40/20/40)
Gel/LX = 1/10

GL-5

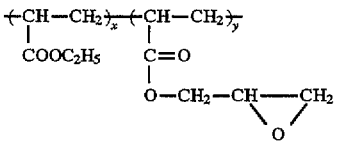

(x/y = 50/50)
Gel/LX = 1/10

GL-6

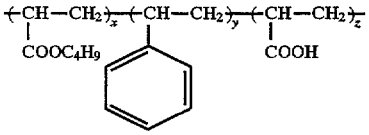

(x/y/z = 39.4/58/1.6)
Gel/LX = 1/10

GL-7

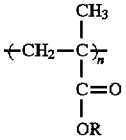

R: $-CH_3$, $C_2H_5$, $C_4H_9$
Gel/LX = 1/4

GL-8

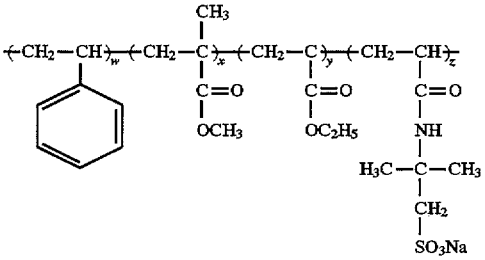

(w/x/y/z = 30/30/32/8)
Gel/LX = 1/5

-continued
GL-9
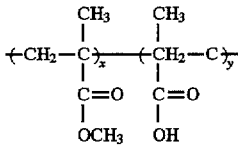
(x/y = 93/7)
Gel/LX = 1/20
GL-10
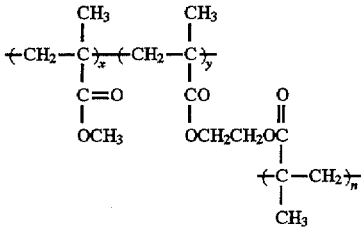
(x/y = 93/7)
Gel/LX = 2/1
GL-11
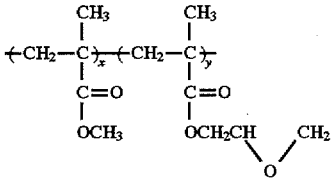
(x/y = 93/7)
Gel/LX = 1/10
GL-12
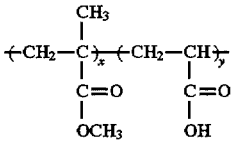
(x/y = 93/7)
Gel/LX = 1/10
GL-13
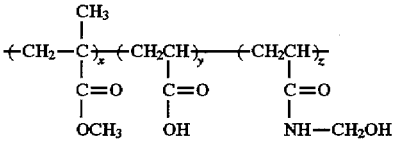
(x/y/z = 93/3/4)
Gel/LX = 1/5
GL-14
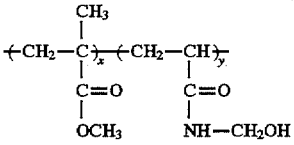
(x/y = 93/7)
Gel/LX = 1/20
GL-15
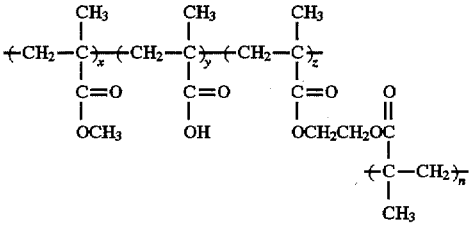
(x/y/z = 93/3/4)
Gel/LX = 1/5
GL-16
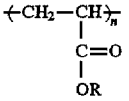
R: $-CH_3$, $-C_2H_5$, $-C_4H_9$
Gel/LX = 1/5
GL-17
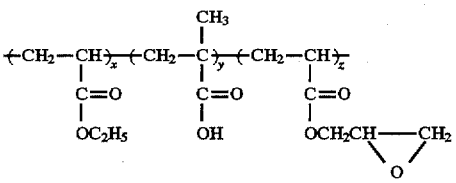
(x/y/z = 93/3/4)
Gel/LX = 1/10

-continued

GL-18

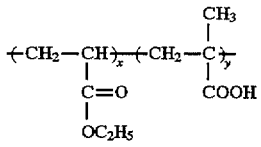

(x/y = 93/7)
Gel/LX = 1/10

GL-19

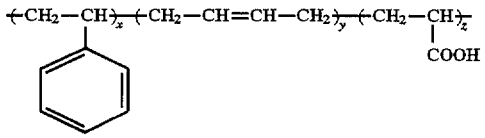

(x/y/z = 59/39/2)
Gel/LX = 1/10

GL-20

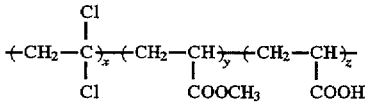

(x/y/z = 85/13/2)
Gel/LX = 1/10

GL-21

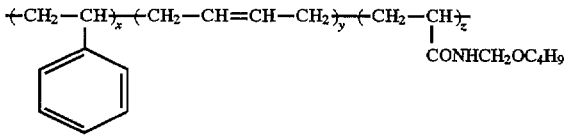

(x/y/z = 64/33/3)
Gel/LX = 1/10

GL-22

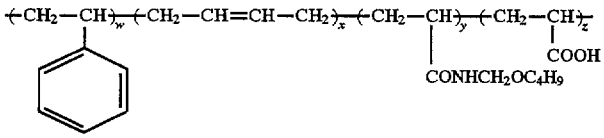

(w/x/y/z = 63/32/3/2)
Gel/LX = 1/10

GL-23

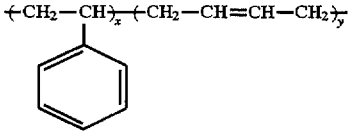

(x/y = 67/33)
Gel/LX = 1/10

GL-24

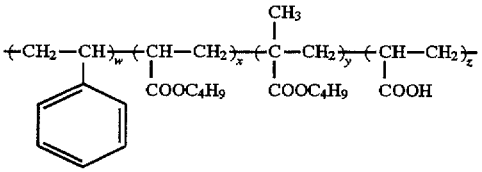

(w/x/y/z = 45/43/8/4)
Gel/LX = 1/10

GL-25

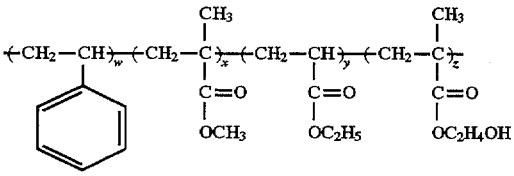

(w/x/y/z = 30/30/32/8)
Gel/LX = 1/10

GL-26

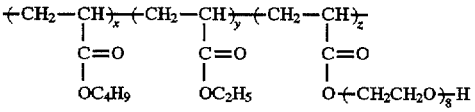

(x/y/z = 40/52/8)
Gel/LX = 1/10

The polymer latex used in the invention is preferably contained in at least one hydrophilic colloid layer. The polymer latex may be contained either in one side of the support or in both sides of the support. It is most preferable that the latex be contained in both of a light-sensitive hydrophilic colloid layer or emulsion layer and a non-light-sensitive hydrophilic colloid layer provided on the same side of the support. The dimensional stabilization effect of the latex becomes most conspicuous when the added amount of the latex comes to 30% by weight or above, particularly 30% to 200% by weight of the gelatin contained in each hydrophilic colloid layer. The whole amount of gelatin contained in the hydrophilic colloid layers provided on the surface of the support on which the latex-containing layer is provided, including the gelatin contained in the latex, is preferably not more than 4 g/m$^2$ on each side, and more preferably 1.5 g/m$^2$ to 2.7 g/m$^2$ for obtaining a remarkable dimensional stability effect. Where the polymer latex is contained in both sides of the support, the kinds and amounts of the polymer latex on the respective sides may be either the same or different.

The above latex, after its synthesis, is adjusted to a pH value within the range of 6.5 to 10.0, and more preferably 7.0 to 9.0. The latex, if used at a lower pH than the above lower limit, tends to get the light-sensitive material into blocking trouble, while if used at a higher pH than the upper limit, makes the material liable to be fogged during its storage period. The pH adjustment is made by use of an alkaline solution, such as a solution of preferably sodium hydroxide, potassium hydroxide or ammonia water.

The water-soluble polymer which may be used with the latex of the invention is a polymer having at least one water-soluble group selected from the class consisting of a sulfo group, a sulfuric ester group, a quaternary ammonium salt group, tertiary ammonium salt group, a carboxyl group and a polyethyleneoxide group. Of these the preferred are the sulfo group, sulfuric ester group and quaternary ammonium salt group. The water-soluble group is preferably required to account for 5% by weight per molecule of the polymer. Monomers to be contained besides the above group in the water-soluble polymer is not particularly restricted, but include an acrylic ester group, a styrene group, a hydroxy group, an amino group, an epoxy group, an aziridine group, an active methylene group, a sulfino group, an aldehyde group and a vinylsulfone group. The molecular weight of the polymer is preferably 3000 to 100000, and more preferably 3500 to 50000.

The following are examples of the water-soluble polymer compound.

Homopolymer A-1

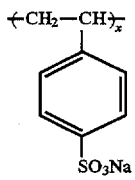

$\overline{M}$ = 60,000

Homopolymer A-2

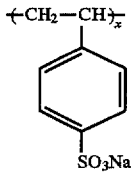

$\overline{M}$ = 70,000

A-3

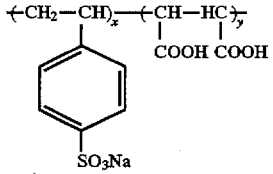

x:y = 75:25
$\overline{M}$ = 5,000

A-4

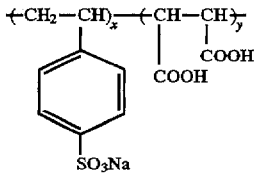

x:y = 50:50
$\overline{M}$ = 12,000

A-5

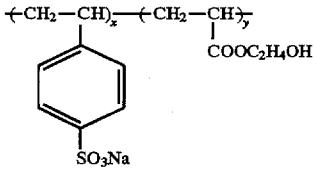

x:y = 70:30
$\overline{M}$ = 5,000

-continued

A-6

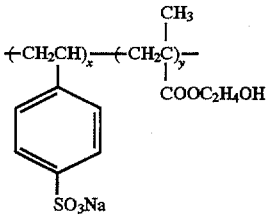

x:y = 90:10
Mn = 10,000

A-7

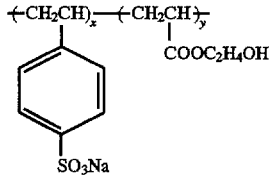

x:y = 60:40
Mn = 7,000

A-8

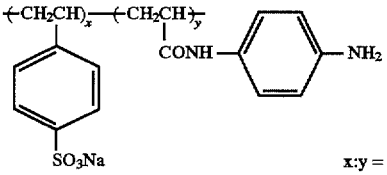

x:y = 90:10
Mn = 15,000

A-9

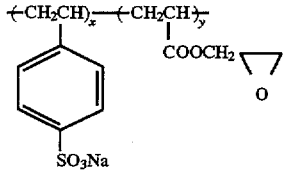

x:y = 60:40
Mn = 5,000

A-10

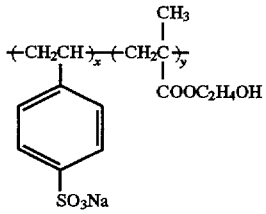

x:y = 90:10
Mn = 20,000

A-11

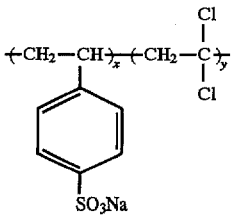

x:y = 97:3
$\overline{M}$ = 30,000

A-12

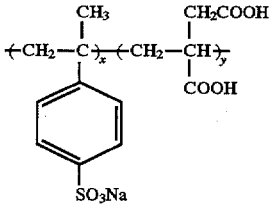

x:y = 98:2
$\overline{M}$ = 5,000

-continued
A-13
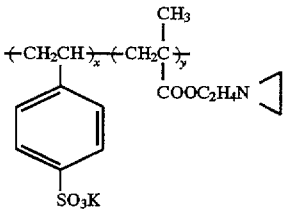
x:y = 60:40
$\overline{M}$ = 8,000
A-14
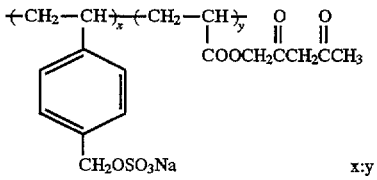
x:y = 95:5
$\overline{M}$ = 25,000
A-15
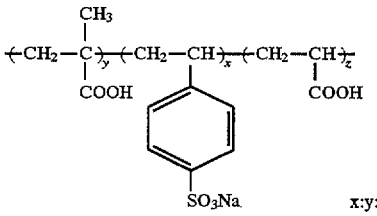
x:y:z: = 80:19:1
$\overline{M}$ = 5,000
A-16
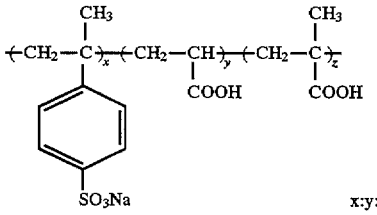
x:y:z = 70:28:2
$\overline{M}$ = 6,000
A-17
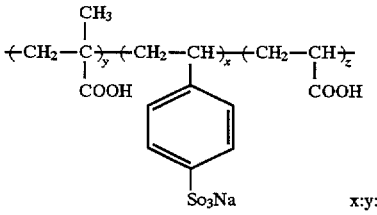
x:y:z = 85:13:2
$\overline{M}$ = 8,000
A-18
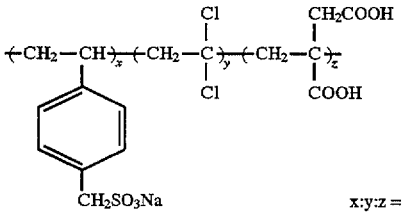
x:y:z = 80:16:4
$\overline{M}$ = 10,000
-continued
A-19
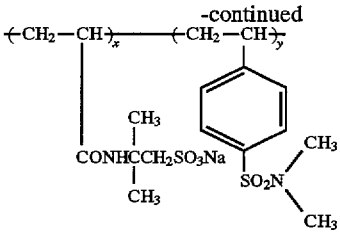
x:y = 90:10
$\overline{M}$ = 30,000
A-20
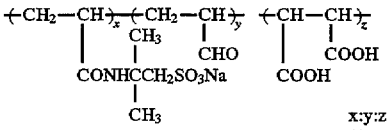
x:y:z = 85:10:5
$\overline{M}$ = 10,000
A-21
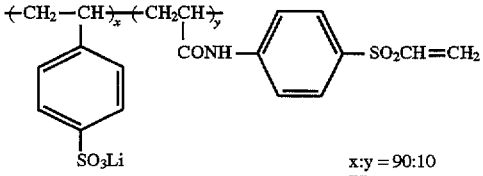
x:y = 90:10
$\overline{M}$ = 6,000
A-22
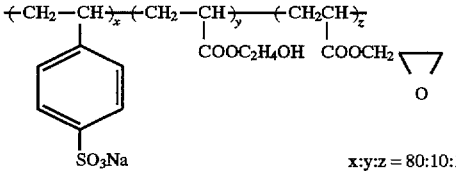
x:y:z = 80:10:10
$\overline{M}$ = 15,000
A-23
Dextran sulfate Substitution degree: 2.0, M = 100,000
A-24
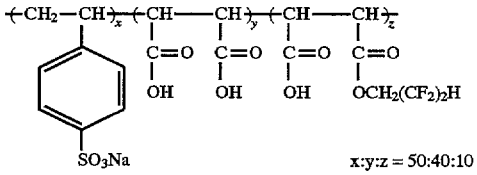
x:y:z = 50:40:10
$\overline{M}$ = 100,000
A-25
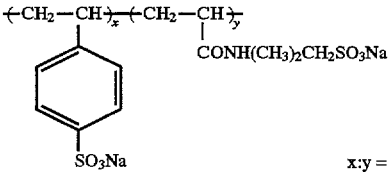
x:y = 80:20
$\overline{M}$ = 50,000
A-26
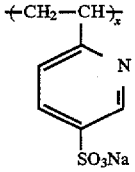
$\overline{M}$ = 100,000
A-27
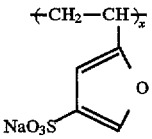
$\overline{M}$ = 20,000

-continued
A-28
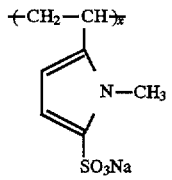
$\overline{M}$ = 20,000
A-29
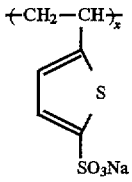
$\overline{M}$ = 150,000
A-30
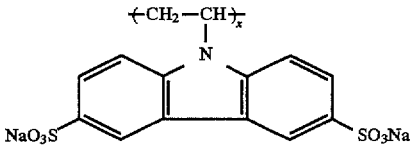
$\overline{M}$ = 300,000
A-31
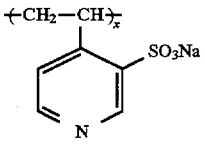
$\overline{M}$ = 280,000
A-32
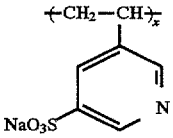
$\overline{M}$ = 50,000
A-33
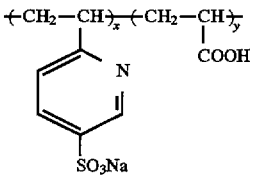
x:y = 60:40
$\overline{M}$ = 80,000
A-34
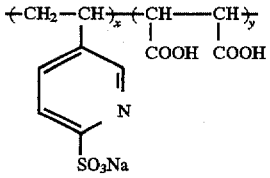
x:y = 70:30
$\overline{M}$ = 5,000
A-35
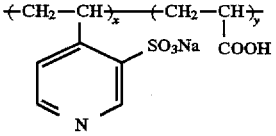
x:y = 80:20
$\overline{M}$ = 50,000
-continued
A-36
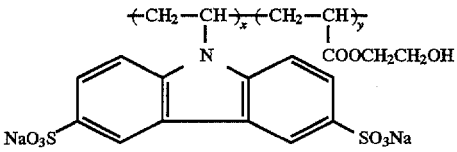
x:y = 75:25
$\overline{M}$ = 40,000
A-37
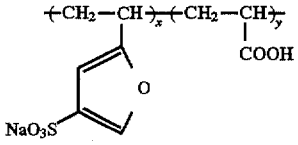
x:y = 80:20
$\overline{M}$ = 60,000
A-38
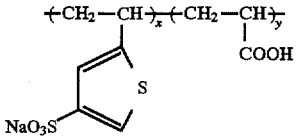
x:y = 90:10
$\overline{M}$ = 40,000
A-39
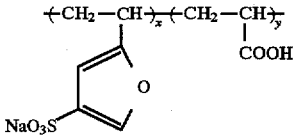
x:y = 55:45
$\overline{M}$ = 20,000
A-40
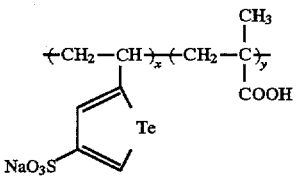
x:y = 90:10
$\overline{M}$ = 60,000
A-41
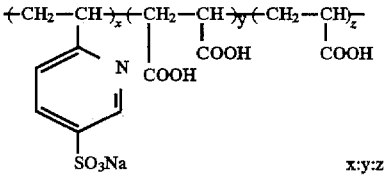
x:y:z = 80:10:10
$\overline{M}$ = 10,000
A-42
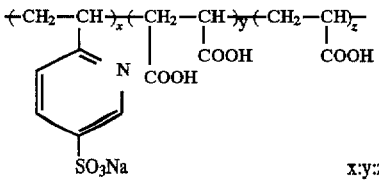
x:y:z = 70:25:5
$\overline{M}$ = 30,000
A-43
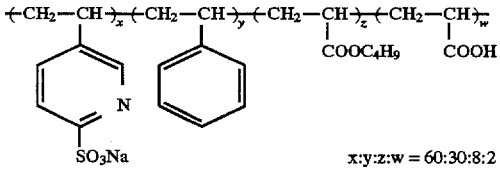
x:y:z:w = 60:30:8:2
$\overline{M}$ = 50,000

-continued

A-44

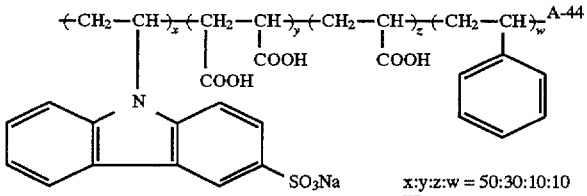

x:y:z:w = 50:30:10:10
$\overline{M}$ ≒ 60,000

A-45

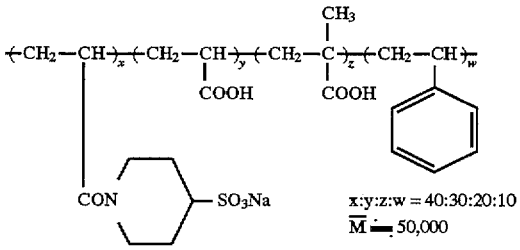

x:y:z:w = 40:30:20:10
$\overline{M}$ ≒ 50,000

A-46

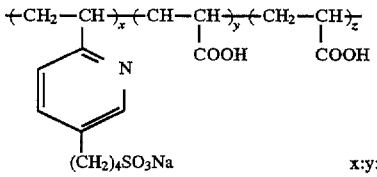

x:y:z = 60:30:10
$\overline{M}$ ≒ 30,000

A-47

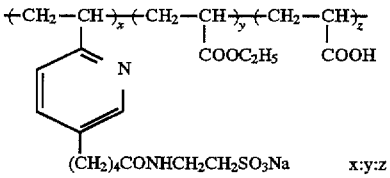

x:y:z = 80:5:15
$\overline{M}$ ≒ 50,000

A-48

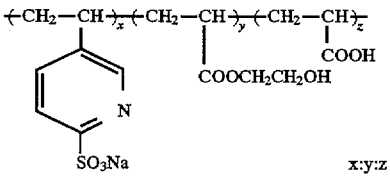

x:y:z = 55:35:10
$\overline{M}$ ≒ 30,000

A-49

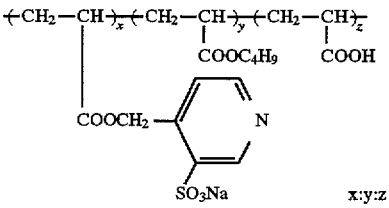

x:y:z = 50:10:40
$\overline{M}$ ≒ 60,000

A-50

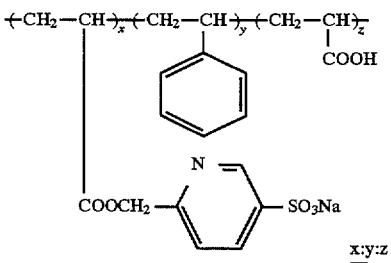

x:y:z = 60:10:30
$\overline{M}$ ≒ 60,000

In the above A-1 through A-50, x, y and z represent mol percentages of the respective monomer components, and $\overline{M}$ represents an average molecular weight. (In the invention, the average molecular weight means a number average molecular weight.)

It is preferable that any one of the above exemplified compounds be added to the latex either as it is or in the form of an aqueous solution.

The above compound may be added during the course of or after the synthesis of a gelatin-stabilized latex. The compound may also be added to a coating liquid containing the latex, but the best results can be obtained when it is added to the latex liquid unpon completion of the synthesis thereof.

The above polymer can be synthesized by the polymerization of those monomers commercially available or obtainable in the usual manner. The added amount of these compounds is preferably 0.01 to 10 g/m$^2$, and more preferably 0.1 to 5 g/m$^2$.

To the emulsion used in the invention generally known additives may be added. For the preparation of silver halide grains and the sensitization thereof any appropriate methods may be used without restrictions, for example, reference can be made to JP O.P.I. No. 230035/1988 and JP Application No. 266640/1989.

It is preferable that at least one of known contrast-increasing agents such as, e.g., tetrazolium compounds and hydrazine derivatives be added to the emulsion according to the invention.

In the invention, the light-sensitive material, for its protection from static electricity, may have one or more antistatic layers on the backing side and/or the emulsion layer side of its support.

In this instance, the specific surface resistivity of the antistatic layer-provided side is preferably not more than $1.0\times10^{11}\Omega$, and more preferably not more than $8\times10^{11}\Omega$.

The above antistatic layer is preferably an antistatic layer containing a reaction product of water-soluble conductive polymer, hydrophobic polymer and a hardening agent, or one containing a metallic oxide.

A preferred one as the above water-soluble conductive polymer is a polymer having at least one conductive group selected from the class consisting of sulfo group, sulfuric ester group, quaternary ammonium salt group, tertiary ammonium salt group, carboxyl group, and polyethylene oxide group. The preferred among these groups are the sulfo group, sulfuric ester group and quaternary ammonium salt group. The conductive group is required to be in an amount of 5% by weight per molecule of the water-soluble conductive polymer. The water-soluble conductive polymer also contains other groups such as a carboxyl group, a hydroxyl group, an amino group, an epoxy group, an azilidine group, an active methylene group, a sulfino group, an aldehydo group, a vinylsulfonyl group, etc., but of them the preferred groups to be contained are the carboxyl group, hydroxy group, amino group, epoxy group, azilidine group and aldehydo group. These groups need to be contained in an amount of 5% by weight per molecule of the polymer. The number average molecular weight of the water-soluble conductive polymer is preferably 3000 to 100000, and more preferably 3500 to 50000.

Useful examples of the above metallic oxide include tin oxide, indium oxide, antimony oxide, zinc oxide, vanadium oxide, and products obtained by doping these metallic oxides with metallic silver, metallic phosphorus or metallic indium. The average particle diameter of these metallic oxides is preferably 1μ to 0.01μ.

As the matting agent applycable to the invention there may be used any one of known materials such as the silica described in Swiss Patent No. 330,158; the-glass powder described in French Patent No. 1,296,995; the inorganic particles such as alkaline earth metals, carbonates of cadmium and zinc, described in British Patent Nos. 1,173,181; the starch described in U.S. Pat. No. 2,322,037; the starch derivatives described in Belgium Patent No. 625,451 and British Patent No. 981,198; the polyvinyl alcohol described in JP E.P. No. 3643/1969; the polystyrene or polymethyl methacrylate described in Swiss Patent No. 330,158; the polyacrylonitrile described in British Patent No. 3,079,257; and the organic particles such as the polycarbonate described in U.S. Pat. No. 3,022,169.

These matting agents may be used alone or in combination. The particle form of the matting agent is normally preferably spherical, but may also be tabular or cubic. The particle size of the matting agent is expressed as the diameter of a spherical particle equivalent in the volume to the particle thereof. The matting agent's particle size in the invention implies the sphere-equivalent particle's diameter.

The embodiment of the invention is such that the outermost layer on the emulsion side preferably contains 4 to 80 $mg/m^2$ of at least one of matting agents having figurate or amorphous particles of a diameter of not less than 4 μm, and more preferably ably contains additionally in combination 4 to 80 $mg/m^2$ of at least one of matting agents having figurate or amorphous particles of less than 4 μm.

That the matting agent is contained in the outermost layer preferably means that at least part of the matting agent is contained in the outermost layer and the rest may reach lower layers.

In order to have the matting agent attain its basic function, the matting agent is preferably partly exposed on the surface of the outermost layer. The matting agent that lies open on the surface may be either part of or the whole of the added matting agent. The addition of the matting agent may be performed in the manner of in advance dispersing it in a coating liquid for the layer or of spraying it onto the layer after its coating and before completion of its drying. Where two or more different kinds of the matting agent are added, both the above methods may be used in combination. Techniques for more effectively adding these matting agents to the light-sensitive material are described in JP O.P.I. No. 91738/1991.

Examples of the subbing layer used in the invention include the polyhydroxybenzene-containing organic solvent subbing layer described in JP O.P.I. No. 3972/1974; the aqueous latex subbing layers described in JP O.P.I. Nos. 11118/1974, 104913/1977, 19941/1984, 19940/1984, 18945/1984, 112326/1976, 117617/1976, 58469/1976, 114120/1976, 121323/1976, 123139/1976, 11412111976, 139320/1977, 65422/1977, 109923/1977, 11991911977, 6594911980, 128332/1982 and 19941/1984; and the vinylidene chloride subbing layers described in U.S. Pat. Nos. 2,698,235, 2,779,684 and 4,645,731.

In the invention, a polyethylene-laminated paper, a polyethylene terephthalate film, a baryta paper or a triacetate film is suitable as a support. The preferred among them is the polyethylene terephthalate film. The thickness of the support is preferably 70 μm to 200 μm.

The subbing layer may be usually subjected to a chemical or physical surface treatment. The treatment includes surface activation treatments such as chemical treatment, mechanical treatment, corona-discharge treatment, flame treatment, UV rays treatment, high-frequency treatment, glow-discharge treatment, active plasma treatment, laser treatment, mixed-acid treatment and ozone-oxidation treatment. The subbing layer is distinguished from the photographic layers of the invention and is subjected to no restrictions on coating time and conditions.

However, the embodiment of the invention shows more remarkable effect when appropriate coatings are made on a vinylidene chloride subbing layer-provided polyester support.

In the invention, in addition to ordinary water-soluble dyes, other solid-dispersed dyes may be contained in some hydrophilic colloid layers including the outermost layer; may be added to a layer underneath the emulsion layer and/or backing-side layer for antihalation purpose; or may also be added in an appropriate amount to the emulsion layer to provide an antiirradiation effect thereto. Plural kinds of solid dispersed dyes may of course be added to a plurality of layers.

The added amount of the solid dispersed dye is preferably 5 $mg/m^2$ to 1 $g/m^2$, more preferably 10 $mg/m^2$ to 800 $mg/m^2$ per kind thereof.

Fine particles of the solid dispersion of the used can be obtained by pulverizing the dye by means of a disperser such as a ball mill or sand mill, and then dispersing the pulverized particles in water or a hydrophilic colloid such as gelatin, containing surfactants such as sodium dodecylbenzenesulfonate, sodium fluorinated octylbenzenesulfonate, nonylphenoxypolyethylene glycol.

The dyes used in the invention are of general formulas as described in U.S. Pat. No. 4,857,446, and those represented by, for examples, Formulas [I] to [V] in the publication are preferably usable.

The invention is applicable to various light-sensitive materials such as those for X-ray use, general negative use, general reversal use, general positive use, direct positive use, but provides particularly remarkable effects when applied to light-sensitive materials for graphic arts use that require a very high dimensional stability.

The silver halide photographic light-sensitive material of the invention is developed at a temperature of preferably not more than 50° C., more preferably 2° C. to 40° C. The developing of the light-sensitive material is normally completed within 2 minutes, but the light-sensitive material provides better results particularly when developed as rapidly as 5 to 60 seconds.

EXAMPLES

Synthesis of Latexes GL-8A to 8F one kilogram of gelatin, 0.01 kg of sodium dodecylbenzenesulfonate and 0.05 kg of ammonium persulfate were dissolved in 60 liters of water; to the solution, with stirring at 60° C., were added under a nitrogen atmospheric condition a mixture of (a) 3.0 kg of styrene, (b) 3.0 kg of methyl methacrylate and (c) 3.2 kg of ethyl acrylate and 0.8 kg of sodium 2-acrylamido-2-methylpropanesulfonate spending about one hour the liquid was subjected to 1.5 hours of stirring and then one hour of steam distillation to remove the residual monomer therefrom; and after that, 1.0 kg of gelatin was further added. After the liquid was cooled to room temperature, sodium hydroxide was used to adjust its pH to 6.0, which was designated as GL-8A. Latexes 8B, 8C, 8E and 8F were prepared in the same manner as in Latex 8A except that their pH values were each adjusted to 7.5, 8.0, 9.0 and 10.5, respectively. Besides, Latex 8D was prepared identically with Latex 8C and 1 kg of water-soluble polymer A-3 was added after the pH adjustment to 8.0. Water was added to each of the obtained latexes to make the whole 75 kg, whereby monodisperse latexes having an average particle diameter of 0.1 μm were obtained.

Synthesis of Latexes 17A to 17F

To a solution of 0.01 kg of sodium dodecylbenzenesulfonate and 0.05 kg of ammonium persulfate dissolved in 40 liters of water, with stirring at 80° C., was added under a nitrogen atmospheric condition spending an hour a mixture liquid of (a) 9.3 kg of ethyl acrylate, (b) 0.4 kg of a reaction product of epichlorohydrine and acrylic acid and (c) 0.3 kg of acrylic acid, and the liquid was stirred for 1.5 hours. After that, the liquid was subjected to addition of 1.0 kg of gelatin and 0.005 kg of ammonium persulfate thereto and another 1.5-hour stirring. After completion of the reaction the system was subjected to steam distillation to remove the residual monomer therefrom. After the liquid was cooled to room temperature, its pH was adjusted by use of ammonia to 6.0, which was designated as GL-17A. Latexes 17B, 17C, 17E and 17F were prepared in the same manner as in Latex 17A except that their pH values were adjusted to 7.5, 8.0, 9.0 and 10.5, respectively. Besides, Latex 17D was prepared identically with Latex 17C and 1 kg of water-soluble polymer A-3 was added after the pH adjustment to 8.0. Water was added to each of the obtained latexes to make the whole 55 kg, whereby monodisperse latexes having an average particle diameter of 0.12 μm were obtained.

Preparation of an emulsion

A silver sulfate solution and a solution prepared by adding a rhodium hexachloride complex salt in an amount of $8\times10^{-5}$ mol/Ag mol to a solution of sodium chloride and potassium bromide with their flow rate being controlled were added simultaneously to a gelatin solution, and the produced emulsion was desired, whereby a cubic monodisperse silver chlorobromide emulsion having an average grain diameter of 0.13 μm, containing 1 mol % silver bromide, was obtained.

The emulsion obtained above was subjected to sulfur sensitization in the usual manner and stabilization by the addition of a stabilizer 6-methyl-4-hydroxy-1,3,3a,7-tetrazaindene, and to this were added the following additives to prepare an emulsion coating liquid. Subsequently, an emulsion protective layer coating liquid, a backing layer coating liquid and a backing protective layer coating liquid having the following compositions were prepared.

Emulsion coating liquid

| | |
|---|---|
| Potassium bromide | 5 mg/m² |
| Compound (a) | 1 mg/m² |
| NaOH (0.5N) | for adjusting pH to 5.6 |
| Compound (b) | 40 mg/m² |
| Saponin (20%) | 0.5 ml/m² |
| Sodium dodecylbenzenesulfonate | 20 mg/m² |
| 5-methylbenzotriazole | 10 mg/m² |
| Compound (d) | 2 mg/m² |
| Compound (e) | 10 mg/m² |
| Compound (f) | 6 mg/m² |
| Inventive Latex LX | amount given in Table 1 |
| Styrene-maleic acid copolymer (thickener) | 90 mg/m² |

(a)

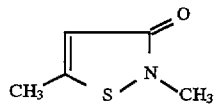

-continued (b)

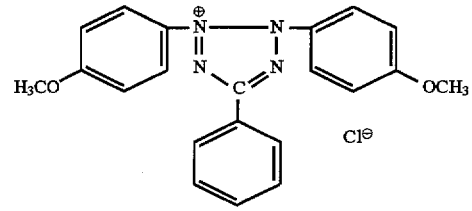

(d)

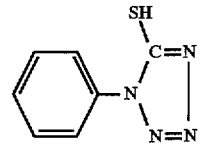

(e)

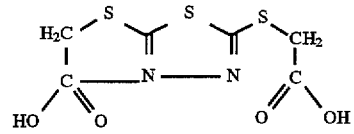

(f)

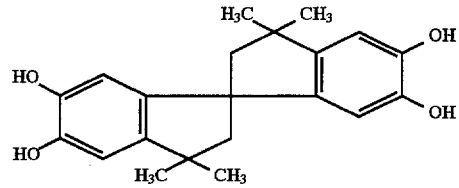

Emulsion protective layer coating liquid

| | |
|---|---|
| Gelatin | 1.1 g/m² |
| Compound (g) (1%) | 25 ml/m² |
| Compound (h) | 40 mg/m² |
| Compound (k) | 100 mg/m² |
| Spherical monodisperse silica (8μ) | 20 mg/m² |
| Spherical monodisperse silica (3μ) | 10 mg/m² |
| Compound (i) | 100 mg/m² |
| Compound (o) | 10 mg/m² |
| Citric acid | for adjusting pH to 5.8 |
| Inventive Latex LX | amount given in Table 1 |
| Styrene-maleic acid copolymer (thickener) | 50 mg/m² |
| Formaldehyde (hardener) | 10 mg/m² |

Backing layer coating liquid

| | |
|---|---|
| Gelatin | 1.7 g/m² |
| Compound (j) | 80 mg/m² |
| Compound (k) | 15 mg/m² |
| Compound (l) | 150 mg/m² |
| Calcium chloride | 0.3 mg/m² |
| Saponin (20%) | 0.6 ml/m² |
| Citric acid | for adjusting pH to 5.5 |
| Latex (m) | 300 mg/m² |
| 5-methylbenzotriazole | 10 mg/m² |
| 5-niroindazole | 20 mg/m² |
| Polyethylene glycol (molecular weight: 1540) | 10 mg/m² |
| Styrene-maleic acid copolymer (thickener) | 45 mg/m² |
| Glyoxal | 4 mg/m² |
| Compound (n) | 80 mg/m² |

Backing protective layer coating liquid

| | |
|---|---|
| Gelatin | 0.9 g/m² |
| Compound (g) (1%) | 2 ml/m² |
| Compound (j) | 20 mg/m² |
| Compound (k) | 4 mg/m² |
| Compound (l) | 50 mg/m² |
| Spherical polymethyl methacrylate (4μ) | 25 mg/m² |
| Sodium chloride | 70 mg/m² |
| Compound (o) | 5 mg/m² |
| Glyoxal | 22 mg/m² |
| Bis-vinylsulfonylmethyl-ether | 5 mg/m² |

-continued (g)

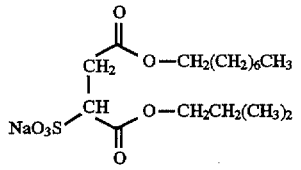

(h)

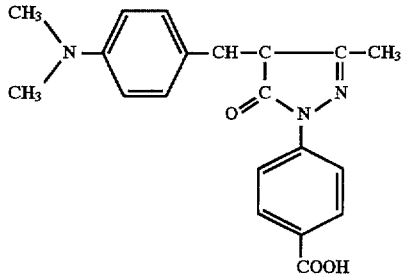

(Solid dispersed dye)

(i)

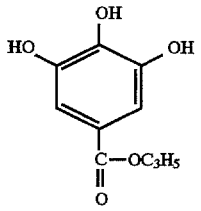

(j)

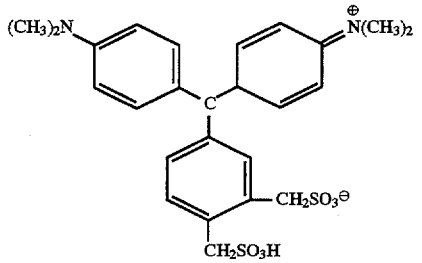

(k)

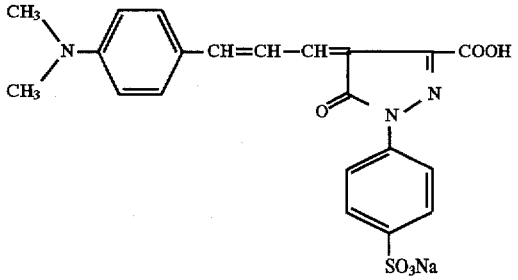

-continued (l)

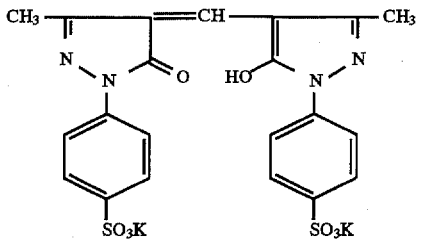

(m)

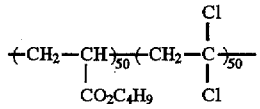

(n)

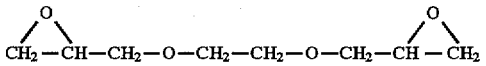

(o)

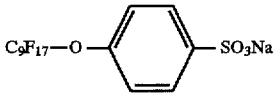

Coating of antistatic layer

A polyethylene terephthalate base of 100μ in thickness having a subbing layer according to JP O.P.I. No. 19941/1984, after having its surface subjected to corona discharge treatment at 10W/($m^2$.min), was coated on one side thereof with a liquid of the following composition by using a roll fit coating pan and air knife so as to have a coating amount of 10 cc/$m^2$. The drying of it was made for 30 seconds at 90° C., then followed by 90 seconds at 140° C., under parallel flow drying conditions having an overall coefficient of heat transfer of 25 kcal/$m^2$.hr. °C. The layer after the drying had a thickness of 1μ and a surface resistivity at 23° C./55% RH of $1\times10^8\Omega$.

| | |
|---|---|
| Water-soluble conductive polymer | 70 g/liter |

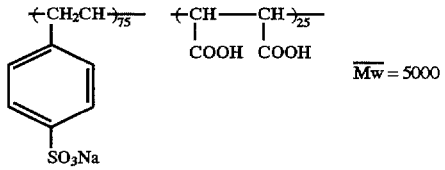

-continued

| | |
|---|---|
| Hydrophobic polymer particles | 40 g/liter |

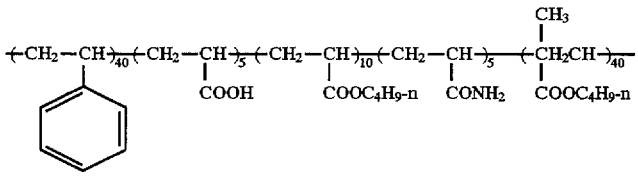

| | |
|---|---|
| Ammonium sulfate | 0.5 g/liter |
| polyethylene oxide (average molecular weight: 600) | 6 g/liter |
| Hardener | 12 g/liter |

A mixture of

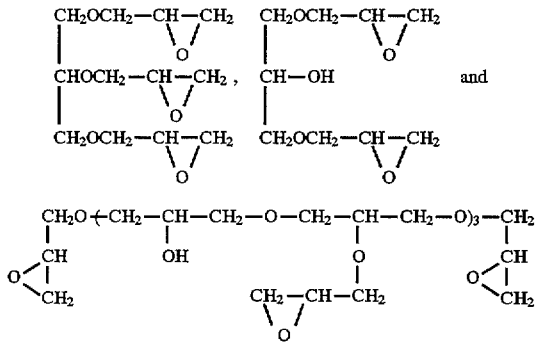

On the non-antistatic-layer side of this support simultaneous multilayer coating of the above-prepared emulsion layer coating liquid and emulsion protective layer coating liquid with their temperature kept at 35° C. was made, while adding a hardener solution thereto, according to a slide hopper process to form an emulsion layer and an emulsion protective layer, respectively, in the described order from the side closer to the support. After passing the layers-coated support through a cooling air setting zone (5° C.), simultaneous multilayer coating of the above-prepared backing layer coating liquid and backing protective layer coating liquid was made, while adding a hardener solution thereto, also according to a slide hopper process to form a backing layer and a backing protective layer, respectively, on the antistatic layer and then the layers were passed through the cooling air setting zone (5° C.). At the point of time of completion of the layers' passing through each cooling air setting zone, the coated liquids had already set enough to form the respective layers. In the subsequent drying zone, both coated sides of the support were dried simultaneously under the following drying conditions. After completion of the backing-side coatings, the film was transported, with its coated surfaces being kept out of contact with rollers and others, to its take-up position. The coating rate used in this instance was 100 m/min.

Drying conditions

The coated light-sensitive material was subjected to drying treatment in a drying air at 30° C. until the $H_2O$/gelatin ratio by weight comes to 800%, then in a drying air at 35° C. (30%) for the $H_2O$/gel ratio range of 800 to 200%, then was left exposed to the drying wind until the time when its surface temperature comes to 34° C., and finally 30 seconds later it was dried for one minute by a drying air at 48° C. 2% RH. In this instance, the drying time consists of 50 seconds from the beginning until the $H_2O$/gel ratio comes to 800%, 35 seconds for the ratio range of from 800% to 200%, and 5 seconds from 200% until completion of the drying.

The above light-sensitive material was taken up under conditions of 23° C./40% RH, then slit and cross-cut into sheets under the same atmospheric condition, and a group of the sheets was packed together with a cardboard leaf that was conditioned to an air of 40° C./10% RH for 8 hours and then to 23° C./40% for 2 hours in a barrier bag that was conditioned to the same environmental condition for 3 hours, and the bag was hermetically sealed.

In the above prepared light-sensitive material, the total coated weights of the gelatin and silver of the layers on the emulsion layer side of its support were 2.3 g/m$^2$ and 3.5 g/m$^2$, respectively.

The thus prepared Samples No. 1 to No. 11 of the light-sensitive material were examined with respect to their dimensional stabilities, blocking conditions, and changes in the sensitivity with time, and evaluated as follows.

Dimensional stability

Each sample was cut into a 30 cm×60 cm size sheet, exposed imagewise to two fine lines arranged at an interval of about 56 cm by using a roomlight-operational printer P-627FM, manufactured by Dai-Nippon Screen Co., and then processed. The processed sample was regarded as an original.

The original, an unexposed sample equal in size to the original, the printer, and an autoprocessor were all conditioned for 2 hours to an air at 23° C./20% RH. After that, the original and the unexposed sample were superposed with their faces brought into contact with each other to be subjected to contact printing, and the exposed sample was processed in the autoprocessor. The sample processed herein, after being conditioned for two hours to the ambient air, was superposed upon the original to visually examine through a graduated magnifier how much difference in the fine lines interval exists between the original and the processed sample. The examination was made with a measuring sample size n=6 and the average of the measured values, balue(a), was used for evaluation.

Similar experiments were made also under conditions of 23° C./60%, and the difference in the dimensional stability between before and after the processing under conditions of the same temperature/20% RH, value(b), was taken to evaluate its dependency upon the ambient humidity.

A discrepancy in the dimension becomes noticed when the (a) value exceeds ±20μ, while changes in the dimensional difference between before and after the processing become noticed when the (b) value exceeds 20μ, so that it is a level that requires some change in the settling of working conditions.

Blocking test

Each sample was cut into 3.5 cm×13.5 cm size sheets, and the sheets, after being conditioned to 23° C./80% for one full day, were all brought into contact with one another packed in a moisture-tight bag to be allowed to stand with a load of 800 g/cm$^2$ over a period of two days at 40° C. After that, the sheets were peeled apart to have the area (%) of sticked portions thereof judged and evaluated according to the following criteria:

Rank A: 0 to 40%

Rank B: 41 to 60%

Rank C: 61 to 80%

Rank D: 81 to 100%

In the above ranking, light-sensitive materials of Ranks A and B are acceptable and those of Ranks C and D are unacceptable for practical use. The light-sensitive materials classified as Ranks C and D in this test make blocking in the course of prolonged storage under practical conditions.

Tests for changes in sensitivity and fog during storage

Two barrier bags of the obtained samples were prepared. One of them was stored under conditions of 23° C./50% RH for five days, while the other was at 55° C. for five days. Both samples were exposed through an optical step wedge, and then processed in the following procedure by using the following developer and fixer solutions. The sensitivity of each sample was represented by an exposure necessary to give a density of 1.0, and expressed as a relative speed to the speed of Comparative Sample 1 set at 100 in the following table.

A decrease in the relative sensitivity to 75 or lower is not acceptable for practical use because reset of exposure condition is necessary to obtain a sufficient image density when the relative sensitivity decreases from 100 to 75 or lower.

Besides, the samples were processed without exposure and were subjected to densitometry with a densitometer for determining fog density thereof. A fog density of more than 0.050 is not acceptable for practical use. Color fog is formed in a picture printed by a PS printing plate when a film with a fog density of 0.05 or more is used for making the printing plate.

| Standard processing conditions | | |
|---|---|---|
| Developing | 28° C. | 30 seconds |
| Fixing | 28° C. | 20 seconds |
| Washing | Normal temperature | 15 seconds |
| Drying | 40° C. | 35 seconds |

| Developer | |
|---|---|
| Composition A: | |
| Pure water (ion-exchanged) | 150 ml |
| Disodium ethylenediaminetetraacetate | 2 g |
| Diethylene glycol | 50 g |
| Potassium sulfite (55% w/v aqueous solution) | 100 ml |
| Potassium carbonate | 50 g |
| Hydroquinone | 15 g |
| 5-methylbenzotriazole | 200 mg |
| 1-Phenyl-5-mercaptotetrazole | 30 mg |
| Potassium hydroxide | for adjusting pH to 10.9 |
| Potassium bromide | 4.5 g |
| Composition B: | |
| Pure water (ion-exchanged) | 3 ml |
| Diethylene glycol | 50 ml |
| Disodium ethylenediaminetetraacetate | 25 mg |
| Sulfuric acid (90% aqueous solution) | 0.3 ml |
| 5-nitoindazole | 110 mg |
| 1-Phenyl-3-pyrazolidone | 500 mg |

When using as a developer solution, the above Composition A and Composition B were dissolved in the order given in 500 ml of water, and water was added to make the whole one liter.

| Fixer bath | |
|---|---|
| Composition A: | |
| Ammonium thiosulfate (100% equivalent) | 168.2 ml |
| Pure water | 5.0 g |
| Sodium sulfite | 5.63 g |
| Sodium acetate, trihydrate | 27.8 g |
| Boric acid | 9.78 g |
| Sodium citrate, dihydrate | 2 g |
| Actic acid (90% w/w aqueous solution) | 6.4 g |
| Composition B: | |
| Pure water (ion-exchanged) | 2.82 g |
| Sulfuric acid (50% w/v aqueous solution) | 6.6 g |
| Aluminum sulfate ($Al_2O_3$ content equivalent to 8.1% w/v aqueous solution) | 26.3 g |

When using as a fixer solution, the above Composition A and Composition B were dissolved in the order given, and water was added to make the whole one liter. pH of the fixer solution was about 4.38.

The results are shown in Table 1.

TABLE 1

| | | Emulsion layer | | Emulsion protective layer | | Dimensional difference between before and after processing | | Blocking after 2 days of storage | Sensitivity variation | | Fog density variation | |
|---|---|---|---|---|---|---|---|---|---|---|---|---|
| | | | Amount | | Amount | | | | 5 days at | 5 days at | 5 days at | 5 days at |
| No. | | LX | g/m$^2$ | LX | g/m$^3$ | (a) | (b) | at 40° C. | 23° C. | 55° C. | 23° C. | 55° C. |
| 1 | (Comp.) | — | — | — | — | +55μ | +65μ | A | 100 | 90 | 0.035 | 0.070 |
| 2 | " | GL-8A | 0.5 | GL-8A | 0.5 | +17μ | +17μ | C | " | 70 | " | 0.065 |
| 3 | (Inv.) | 8B | " | 8B | " | " | " | B | " | 84 | " | 0.045 |
| 4 | " | GL-8C | " | 8C | " | " | " | B | " | 85 | " | 0.045 |
| 5 | " | GL-8D | " | 8D | " | " | " | A | " | 90 | " | 0.040 |
| 6 | " | 8E | " | 8E | " | " | " | B | " | 84 | " | 0.046 |

TABLE 1-continued

| | | Emulsion layer | | Emulsion protective layer | | Dimensional difference between before and after processing | | Blocking after 2 days of storage | Sensitivity variation | | Fog density variation | |
|---|---|---|---|---|---|---|---|---|---|---|---|---|
| | | | Amount | | Amount | | | | 5 days at | 5 days at | 5 days at | 5 days at |
| No. | | LX | g/m² | LX | g/m³ | (a) | (b) | at 40° C. | 23° C. | 55° C. | 23° C. | 55° C. |
| 7 | (Comp.) | 8F | " | 8F | " | " | " | B | " | 84 | " | 0.075 |
| 8 | " | GL-17A | " | GL-17A | " | " | " | C | " | 70 | " | 0.065 |
| 9 | (Inv.) | 17B | " | 17B | " | " | " | B | " | 80 | " | 0.045 |
| 10 | " | 17C | " | 17C | " | " | " | B | " | 80 | " | 0.045 |
| 11 | " | 17D | " | 17D | " | " | " | A | " | 90 | " | 0.042 |
| 12 | " | 17E | " | 17E | " | " | " | B | " | 80 | " | 0.045 |
| 13 | (Comp.) | 17F | " | 17F | " | " | " | B | " | 80 | " | 0.075 |

From the results shown in Table 1 it is understood that the samples of the invention have less blocking trouble, less sensitivity change with time and more excellent dimensional stability than the comparative samples.

EXAMPLE 2

Experiments were made in the same manner as in Example 1 except that the Compound b used in the emulsion coating liquid in Example 1 was replaced by the following compound, and consequently the results were as good as those of Example 1.

The results are shown in Table 2.

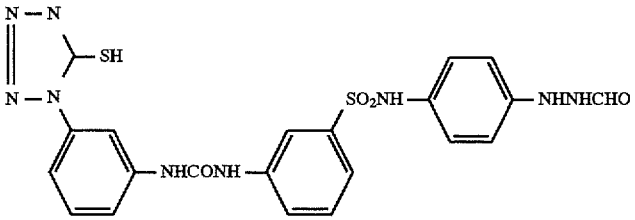

TABLE 2

| | | Emulsion layer | | Emulsion protective layer | | Dimensional difference between before and after processing | | Blocking after 2 days of storage | Sensitivity variation | | Fog density variation | |
|---|---|---|---|---|---|---|---|---|---|---|---|---|
| | | | Amount | | Amount | | | | 5 days at | 5 days at | 5 days at | 5 days at |
| No. | | LX | g/m² | LX | g/m³ | (a) | (b) | at 40° C. | 23° C. | 55° C. | 23° C. | 55° C. |
| 21 | (Comp.) | — | — | — | — | +53μ | +63μ | A | 100 | 75 | 0.035 | 0.070 |
| 22 | " | GL-8A | 0.5 | — | — | +35μ | +40μ | B | " | 70 | " | 0.060 |
| 23 | " | GL-8A | " | GL-8A | 0.5 | +17μ | +17μ | C | " | 60 | " | 0.055 |
| 24 | (Inv.) | GL-8B | " | GL-8B | " | " | " | B | " | 85 | " | 0.045 |
| 25 | " | GL-8C | " | GL-8C | " | " | " | B | " | 90 | " | 0.040 |
| 26 | " | GL-8D | " | GL-8D | " | " | " | A | " | 95 | " | 0.040 |
| 27 | " | GL-8D | " | — | — | +30μ | +38μ | B | " | 90 | " | 0.045 |
| 28 | " | GL-8E | " | GL-8E | 0.5 | +17μ | +17μ | B | " | 90 | " | 0.045 |
| 29 | (Comp.) | GL-8F | " | GL-8F | " | " | " | B | " | 90 | " | 0.075 |

What is claimed is:

1. A silver halide photographic light-sensitive material comprising a support with two sides, a light-sensitive silver halide emulsion layer provided on a side of said support, an emulsion protective layer provided on said emulsion layer, a backing layer provided on another side of the support and a backing protective layer provided on said backing layer, wherein said silver halide emulsion layer, emulsion protective layer, backing layer and backing protective layer each comprises gelatin and a first layer of said emulsion layer, emulsion protective layer, backing layer or backing protective layer contains a latex of a copolymer of alkyl acrylate, styrene and acrylic acid; a copolymer of alkyl acrylate, styrene and N-methylol acrylamide; a copolymer of alkyl acrylate, styrene and glycidyl methacrylate; a copolymer of alkyl acrylate, styrene and methyl methacrylate;

a copolymer of alkyl acrylate and acrylic acid; or a copolymer of alkyl acrylate and N-methylol acrylamide;

said latex being contained in an amount of 30% to 200% by weight of gelatin contained in the layer in which said latex is to be contained;

the total amount of gelatin provided on the side of the support on which said latex-containing layer is provided is 1.5 $g/m^2$ to 2.7 $g/m^2$; and said latex is polymerized in the presence of gelatin or is reacted with gelatin after polymerization with a weight ratio of gelatin/polymer of 1:100 to 2:1; and said latex after polymerization has a pH value of from 7 to 9 at the time of addition to a coating solution for forming said emulsion layer or said hydrophilic colloid layer.

2. The light-sensitive material of claim 1, wherein said ratio of gel/polymer is 1:50 to 1:2.

3. The light-sensitive material of claim 1, wherein said polymer latex further contains a water-soluble polymer which is added to said latex after the completion of the polymerization reaction of the latex particles.

4. The light-sensitive material of claim 3, wherein said water-soluble polymer is one containing a sulfonic acid group, a sulfuric ester group, quaternary ammonium salt group, tertiary ammonium salt group, a carboxyl group or a polyethylene oxide group.

5. The light-sensitive material of claim 3, wherein the amount of said water-soluble polymer added with said latex is 0.01 $g/m^2$ to 10 $g/m^2$.

6. The light-sensitive material of claim 5, wherein the amount of said water-soluble polymer added with said latex is 0.1 $g/m^2$ to 5 $g/m^2$.

7. The light-sensitive material of claim 1, wherein said latex is contained in both of said silver halide emulsion layer and a non-light-sensitive hydrophilic colloid layer provided on the side of said support on which said silver halide emulsion layer is provided.

8. The light-sensitive material of claim 1, wherein said latex is one prepared by polymerization of monomers in a surfactant and reacting the polymer latex with gelatin using a gelatin cross-linking agent in a weight ratio of gel/polymer of 1:100 to 2:1.

9. The light-sensitive material of claim 8, wherein said ratio of gel/polymer is 1:50 to 1:2.

10. The light sensitive material of claim 8, wherein said gelatin cross-linking agent is an aldehyde, glycol, triazine, epoxy, vinylsulfone, oxazoline, metharyl or acryl cross-linking agent.

11. The light-sensitive material of claim 8, wherein the polymer latex further comprises 0.01 $g/m^2$ to 10 $g/m^2$ of a water-soluble polymer which is added to said latex after the completion of the polymerization reaction of the latex particles; and said water-soluble polymer is one containing a sulfonic acid group, a sulfuric ester group, a quaternary ammonium salt group, a tertiary ammonium salt group, a carboxyl group or a polyethylene oxide group.

12. The light-sensitive material of claim 7, wherein the polymer latex further comprises 0.01 $g/m^2$ to 10 $g/m^2$ of a water-soluble polymer which is added to said latex after the completion of the polymerization reaction of the latex particles; and said water-soluble polymer is one containing a sulfonic acid group, a sulfuric ester group, a quaternary ammonium salt group, a tertiary ammonium salt group, a carboxyl group or a polyethylene oxide group.

13. The light-sensitive material of claim 1, wherein said copolymer of the latex contains 2-acrylamido-2- methylpropane sulfonic acid as a component monomer.

14. The light-sensitive material of claim 12, wherein said copolymer of latex is a copolymer of acrylate, methacrylate, styrene and 2-acrylamido-2-methylpropanesulfonic acid having a styrene content of not lower than 25% by weight.

15. The light-sensitive material of claim 1, wherein a second layer of said emulsion layer, emulsion protective layer, backing layer or backing protective layer contains said latex in an amount of 30% to 200% by weight of gelatin contained in said second layer, said second layer being on a different side of said support from said first layer; and the total amount of gelatin provided on said different side of said support is 1.5 $g/m^2$ to 2.7 $g/m^2$.

* * * * *

UNITED STATES PATENT AND TRADEMARK OFFICE

CERTIFICATE OF CORRECTION

PATENT NO. : 5,681,688
DATED : October 28, 1997
INVENTOR(S) : Yasuhiko TAKAMUKI

It is certified that error appears in the above-indentified patent and that said Letters Patent is hereby corrected as shown below:

| | |
|---|---|
| Title Page, under "[*] Notice:" | Change "Pat. No. 5,414,986" to --Pat. No. 5,415,986--. |

Signed and Sealed this

Twenty-first Day of April, 1998

Bruce Lehman

*Attest:*

BRUCE LEHMAN

*Attesting Officer*

*Commissioner of Patents and Trademarks*